US011078611B2

(12) United States Patent
Kim et al.

(10) Patent No.: US 11,078,611 B2
(45) Date of Patent: Aug. 3, 2021

(54) WASHING MACHINE AND CONTROL METHOD THEREOF

(71) Applicant: SAMSUNG ELECTRONICS CO., LTD., Suwon-si (KR)

(72) Inventors: Yong-Kwon Kim, Yongin-si (KR); Myung-Hee Ryu, Suwon-si (KR); Sang Up Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

(21) Appl. No.: 16/327,938

(22) PCT Filed: Jul. 18, 2017

(86) PCT No.: PCT/KR2017/007691
§ 371 (c)(1),
(2) Date: Feb. 25, 2019

(87) PCT Pub. No.: WO2018/038399
PCT Pub. Date: Mar. 1, 2018

(65) Prior Publication Data

US 2019/0186064 A1 Jun. 20, 2019

(30) Foreign Application Priority Data

Aug. 25, 2016 (KR) ..... 10-2016-0108600

(51) Int. Cl.
*D06F 33/00* (2020.01)
*D06F 34/18* (2020.01)
(Continued)

(52) U.S. Cl.
CPC ..... *D06F 33/00* (2013.01); *D06F 34/18* (2020.02); *D06F 34/28* (2020.02); *D06F 37/14* (2013.01); *D06F 37/24* (2013.01); *D06F 37/26* (2013.01); *D06F 39/088* (2013.01); *D06F 39/12* (2013.01); *D06F 37/16* (2013.01); *D06F 37/245* (2013.01);
(Continued)

(58) Field of Classification Search
None
See application file for complete search history.

(56) References Cited

FOREIGN PATENT DOCUMENTS

| | | |
|---|---|---|
| JP | 10-85479 | 4/1998 |
| KR | 10-1175731 | 8/2012 |

(Continued)

OTHER PUBLICATIONS

English machine translation of KR10-2015-0106680.*
(Continued)

*Primary Examiner* — Michael E Barr
*Assistant Examiner* — Jason P Riggleman
(74) *Attorney, Agent, or Firm* — Staas & Halsey LLP

(57) ABSTRACT

Provided is a washing machine and control method thereof. The washing machine includes at least one magnet attached to an auxiliary wash tub detachable from a main wash tub; a switching device configured to output a detection signal when the at least one magnet approaches within a preset range to the switching device; and a controller configured to determine whether the auxiliary wash tub is installed based on whether the detection signal of the switching device is output, and control a component in the washing machine based on the determination of whether the auxiliary wash tub is installed.

10 Claims, 17 Drawing Sheets

(51) Int. Cl.

| | |
|---|---|
| ***D06F 34/28*** | (2020.01) |
| ***D06F 39/12*** | (2006.01) |
| ***D06F 37/14*** | (2006.01) |
| ***D06F 37/24*** | (2006.01) |
| ***D06F 37/26*** | (2006.01) |
| ***D06F 39/08*** | (2006.01) |
| *D06F 37/16* | (2006.01) |

(52) U.S. Cl.
CPC .... *D06F 2202/12* (2013.01); *D06F 2204/086* (2013.01); *D06F 2210/00* (2013.01); *D06F 2212/02* (2013.01); *D06F 2216/00* (2013.01)

(56) References Cited

FOREIGN PATENT DOCUMENTS

| | | | |
|---|---|---|---|
| KR | 10-1242067 | | 3/2013 |
| KR | 10-2015-0030806 | | 3/2015 |
| KR | 10-2015-0106680 | * | 9/2015 |
| KR | 10-2015-0106680 A | * | 9/2015 |

OTHER PUBLICATIONS

English machine translation of KR-10-2015-0106680A.*
International Search Report dated Oct. 13, 2017 from International Patent Application No. PCT/KR2017/007691, 5 pages.
Written Opinion of the International Searching Authority dated Oct. 13, 2017 from International Patent Application No. PCT/KR2017/007691, 9 pages.

* cited by examiner

WASHING MACHINE AND CONTROL METHOD THEREOF

TECHNICAL FIELD

The present disclosure relates to a washing machine having an auxiliary wash tub and control method of the washing machine.

BACKGROUND ART

Washing machines are machines for using electric power to wash clothes, and may be generally classified into fully automatic washing machines that stir laundry and water by rotation of a pulsator and produce water currents to wash the laundry and drum-type washing machines that use a lifter formed in a drum to drop and wash the laundry.

The fully automatic washing machine includes a tub for storing water, a spin tub rotationally installed in the tub, a pulsator rotationally installed at the bottom of the spin tub, and a driving device for driving the spin tub and pulsator to be rotated.

Recently, it has become possible to sort out and wash the laundry separately by installing an auxiliary wash tub in the spin tub. With the auxiliary wash tub, separate washing by the type of the laundry is enabled, so it is efficient in time and economically for the consumer to use the washing machine.

DISCLOSURE

Technical Problem

The present disclosure provides a washing machine and control method thereof, capable of determining whether an auxiliary wash tub is installed and even whether the auxiliary wash tub is properly installed and controlling the position of a knob mounted on the auxiliary wash tub. The present disclosure also provides a washing machine and control method thereof, capable of detecting whether the laundry accommodated in an auxiliary wash tub deviates therefrom.

In accordance with an aspect of the disclosure, a washing machine includes at least one magnet attached to an auxiliary wash tub detachable from a main wash tub; a switching device configured to output a detection signal when the at least one magnet approaches within a preset range to the switching device; and a controller configured to determine whether the auxiliary wash tub is installed based on whether the detection signal of the switching device is output, and control a component in the washing machine based on the determination of whether the auxiliary wash tub is installed.

The controller may determine at least one of whether the auxiliary wash tub is installed and whether the auxiliary wash tub is properly installed based on the number of times of the detection signal being output from the switching device as rotational force is provided through a driving device.

The controller may determine that the auxiliary wash tub is installed when the detection signal is output at least once from the switching device, and determine whether the auxiliary wash tub is properly installed based on the number of times of the detection signal being output from the switching device as the auxiliary wash tub is rotated at preset rotation speed for a preset period of rotation time.

The controller may determine a position of the at least one magnet based on the detection signal output from the switching device, and control a position of a knob provided at the auxiliary wash tub based on the determined position of the at least one magnet.

The washing machine may further include a sensor part attached to an upper portion of a tub provided in the washing machine and configured to detect whether laundry accommodated in the auxiliary wash tub deviates.

The sensor part may include two infrared ray (IR) sensors located opposite each other in an upper portion of the tub.

The controller may determine whether laundry accommodated in the auxiliary wash tub deviates based on a detection result through the sensor part, and when it is determined that the laundry deviates, control a component in the washing machine to supply water to the auxiliary wash tub.

In accordance with another aspect of the disclosure, a washing machine includes at least one magnet attached to an auxiliary wash tub; a switching device configured to output a detection signal when the at least one magnet approaches within a preset range to the switching device; and a controller configured to determine a position of a knob provided at the auxiliary wash tub based on the detection signal output from the switching device as the auxiliary wash tub is rotated, and determine an extent of rotation of the auxiliary wash tub based on the determination of the position of the knob.

The controller may determine a position of the at least one magnet attached to the auxiliary wash tub based on the detection signal output from the switching device, determine a position of the knob provided at the auxiliary wash tub based on the determined position of the at least one magnet, and determine an extent of rotation of the auxiliary wash tub based on the determination of the position of the knob.

The washing machine may further include a sensor part attached to an upper portion of a tub and configured to detect whether laundry accommodated in the auxiliary wash tub deviates.

The controller may determine whether laundry accommodated in the auxiliary wash tub deviates based on a detection result through the sensor part, and when it is determined that the laundry deviates, control a component in the washing machine to supply water to the auxiliary wash tub.

In accordance with another aspect of the disclosure, a control method of a washing machine includes detecting whether a detection signal is output as at least one magnet attached to an auxiliary wash tub detachable from a main wash tub and a switching device attached to an upper portion of a tub approach within a preset range; determine at least one of whether the auxiliary wash tub is installed and whether the auxiliary wash tub is properly installed based on the detection of the detection signal; and controlling a component in the washing machine based on the determination.

The determining may include determining at least one of whether the auxiliary wash tub is installed and whether the auxiliary wash tub is properly installed, based on whether the detection signal is output from the switching device and the number of times of the detection signal being output as rotational force is provided through a driving device.

The determining may include determining that the auxiliary wash tub is installed when the detection signal is output at least once, and determining whether the auxiliary wash tub is properly installed based on the number of times of the detection signal being output as the auxiliary wash tub is rotated at preset rotation speed for a preset period of rotation time.

In accordance with another aspect of the disclosure, a control method of a washing machine includes receiving a detection signal output when at least one magnet attached to an auxiliary wash tub and a switching device attached to an upper portion of a tub approach within a preset range; determining a position of a knob provided at the auxiliary wash tub based on a result of reception of the output detection signal; and determining an extent of rotation of the auxiliary wash tub based on the determination of the position of the knob.

Advantageous Effects

According to a washing machine and control method thereof in accordance with an embodiment, the washing machine and the laundry may be protected from being damaged by determining not only whether an auxiliary wash tub is installed but also determining whether it is properly installed.

According to a washing machine and control method thereof in accordance with another embodiment, the user may more easily remove an auxiliary wash tub by controlling the position of a knob mounted on the auxiliary wash tub.

According to a washing machine and control method thereof in accordance with another embodiment, the washing machine and the laundry may be protected from being damaged by detecting deviation of the laundry accommodated in an auxiliary wash tub.

MODES OF THE INVENTION

In general, a fully automatic washing machine is a device including a tub for storing water (wash water or rinse water), a wash tub rotationally installed inside the tub and accommodating laundry, a pulsator rotationally installed inside the wash tub and producing water currents, and a motor for generating driving power to rotate the wash tub and the pulsator, to remove dirt from the laundry by surface activity between water current and detergent.

The following embodiments are not exclusively applied to fully automatic washing machines of a top-loading type, but may be applied to drum washers of a front-loading type as well, which washes laundry using falling of the laundry while the wash tub accommodating the laundry is rotated, without limitation. A structure of a washing machine will now be described in detail.

Figure 1:
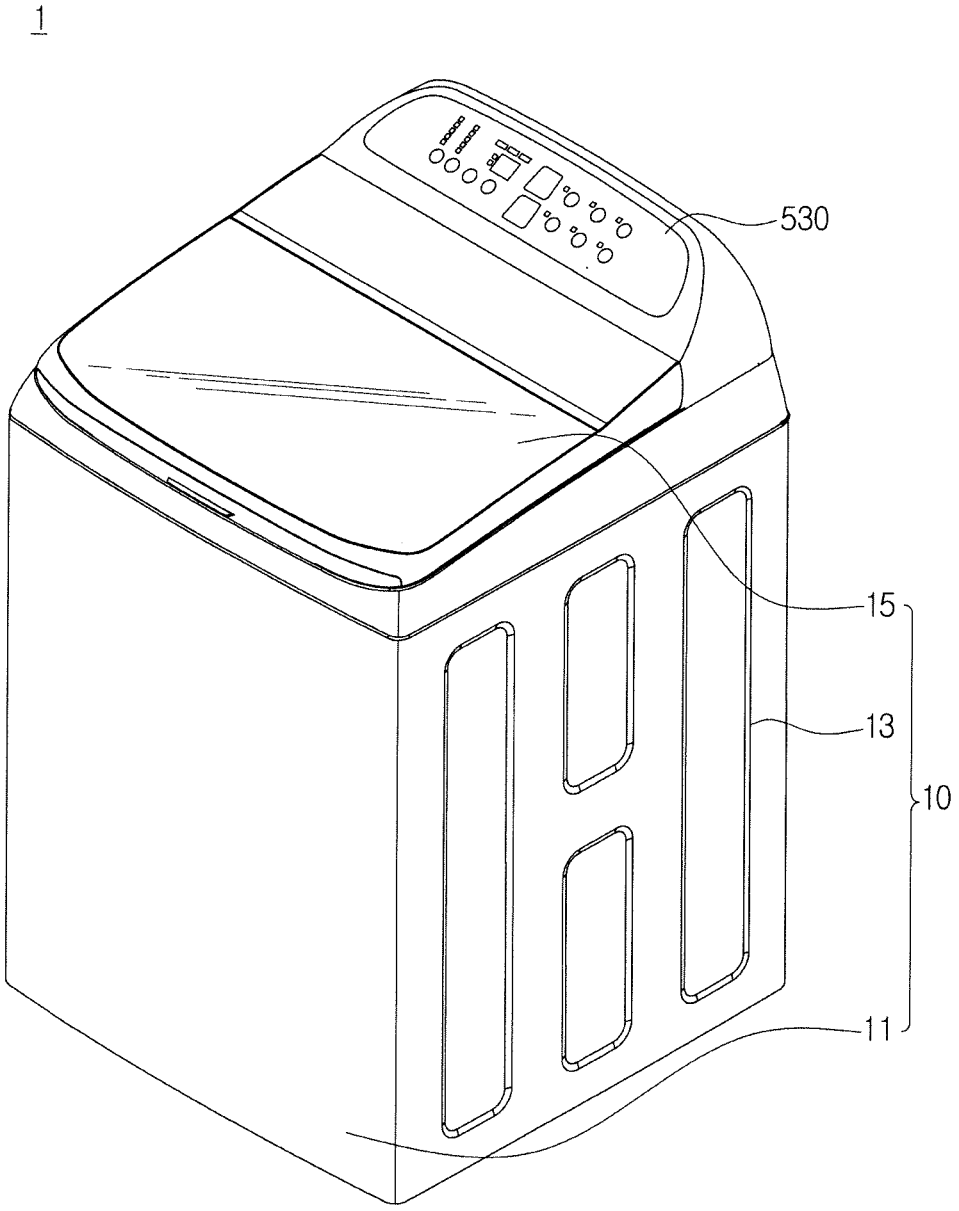
FIG. 1 is a perspective view of a washing machine, according to an embodiment.
Figure 2:
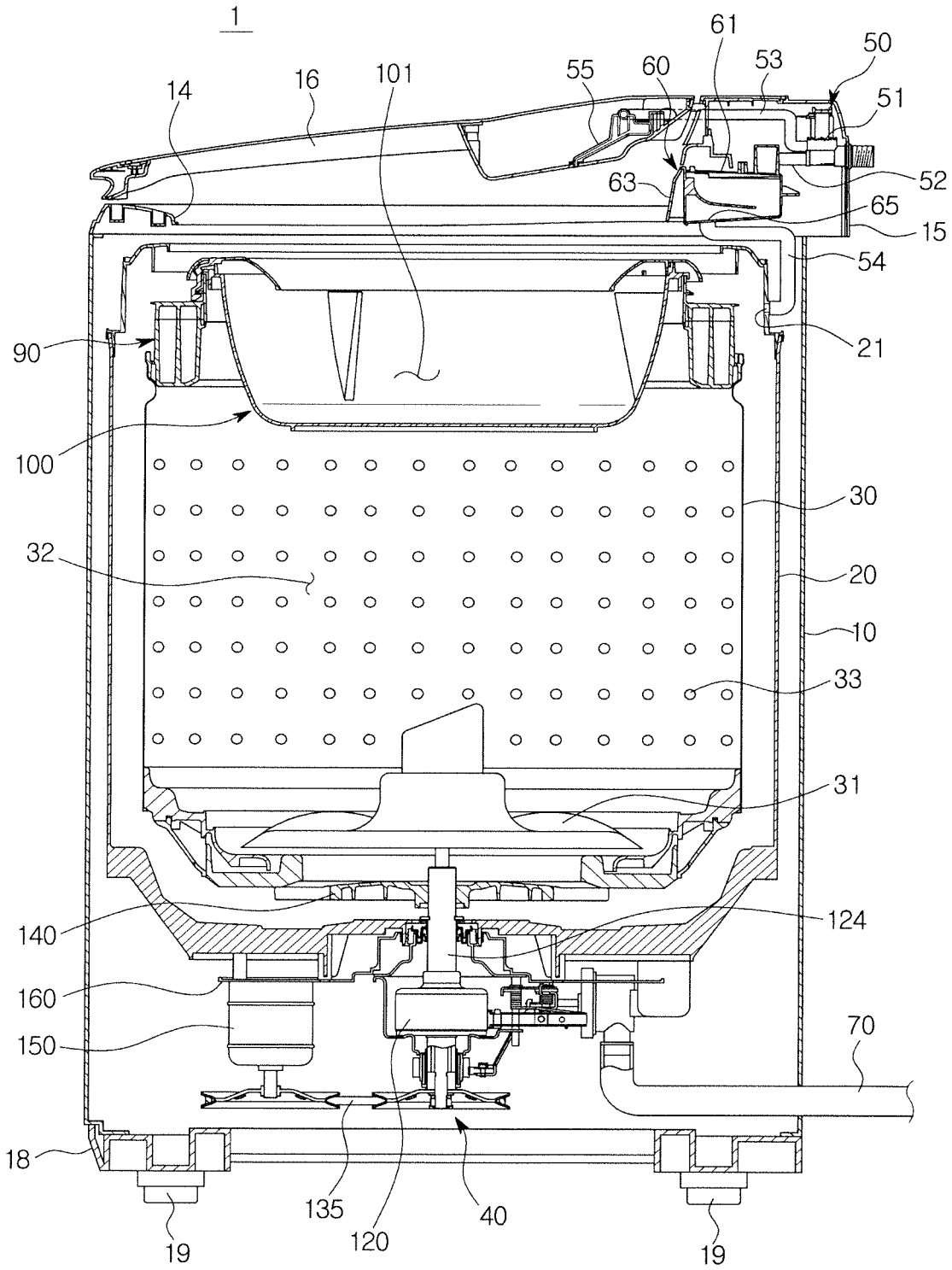
FIG. 2 is a cross-sectional view of a washing machine, according to an embodiment.
Figure 3:
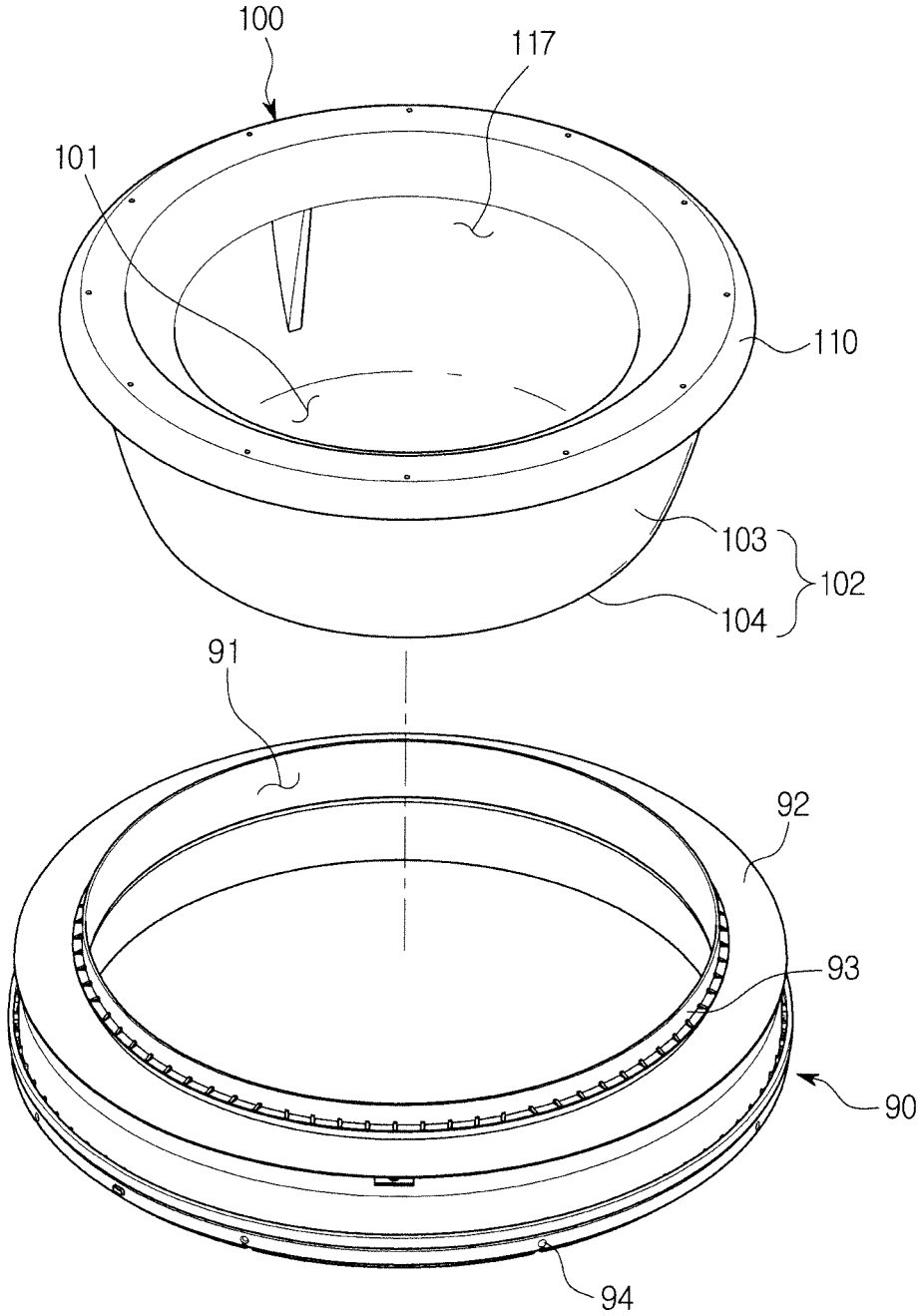
FIG. 3 shows an auxiliary wash tub and a balancer separated from each other, according to an embodiment.
Figure 4:
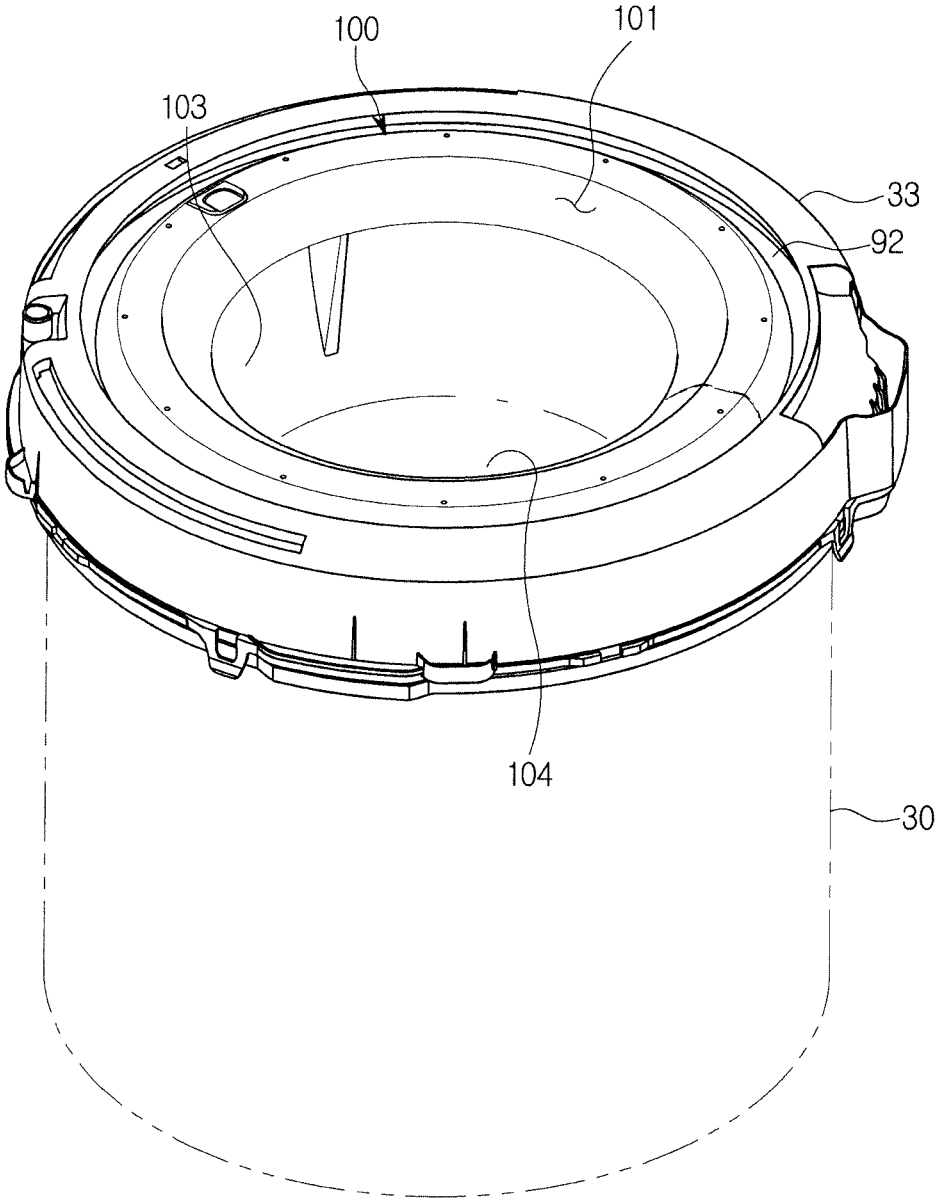
FIG. 4 shows an auxiliary wash tub installed at a balancer, according to an embodiment.
Figure 5:
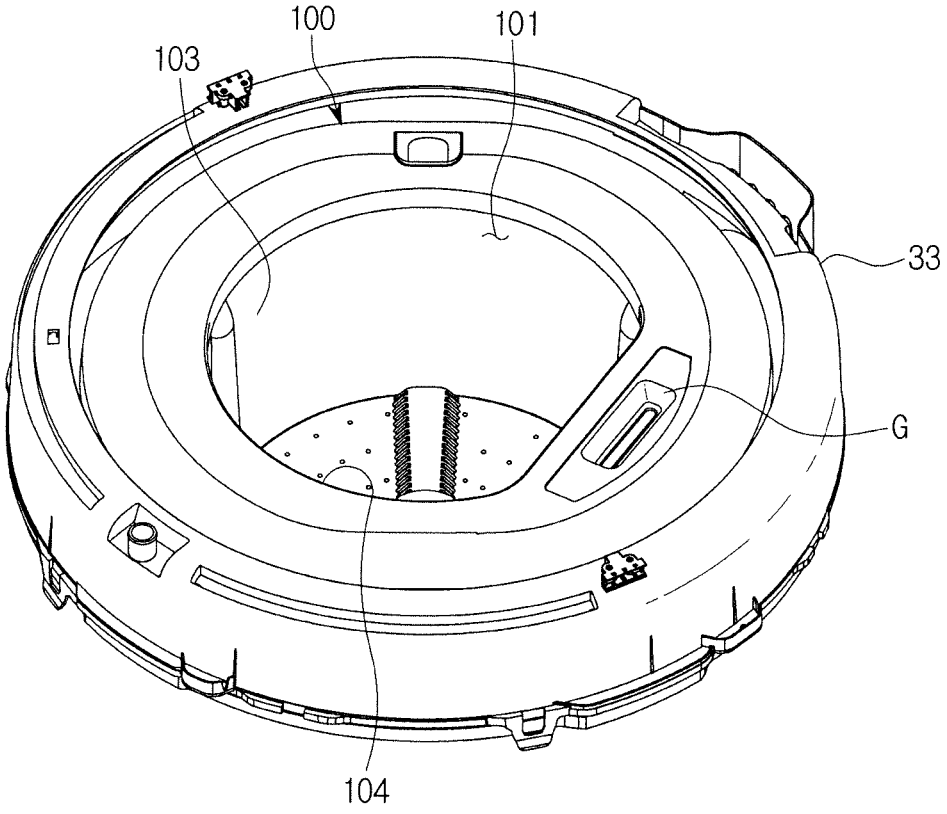
FIG. 5 shows an auxiliary wash tub equipped with a knob installed at a balancer, according to an embodiment.

FIG. 1 is a perspective view of a washing machine, according to an embodiment, and FIG. 2 is a cross-sectional view of a washing machine, according to an embodiment. FIG. 3 shows an auxiliary wash tub and a balancer separated from each other, according to an embodiment, FIG. 4 shows an auxiliary wash tub installed at a balancer, according to an embodiment, and FIG. 5 shows an auxiliary wash tub equipped with a knob installed at a balancer, according to an embodiment. The figures will now be described together to avoid repetition of explanation.

A washing machine 1 may include a cabinet 10 having a top cover 15, a front cover 11, a side-rear cover 13, and a bottom cover 18 (see FIG. 2), all of which form the exterior of the washing machine 1. On the top of the top cover 15, there may be an interface 530 provided to receive various control commands and visually present various information. The interface 530 will be described later in more detail.

Referring to FIG. 2, the washing machine 1 may include the cabinet 10 forming the exterior, a tub 20 provided in the cabinet 10 for storing water, a main wash tub 30 rotationally arranged inside the tub 20, a pulsator 31 arranged inside the main wash tub 30 for producing water currents, and a driving device 40 for rotating the main wash tub 30 or the pulsator 31.

As described above, the cabinet 10 may include the top cover 15 and the bottom cover 18. An inlet 14 may be formed on the top cover 15 to throw laundry into the main wash tub 30, and opened or closed by a door 16 installed at the top of the cabinet 10. Furthermore, a ground module 19 may be installed at the bottom cover 18 to fix the washing machine 1 to the floor.

A water supplier 50 may be provided in an upper portion of the cabinet 10 to supply wash water to at least one of the main wash tub 30 and an auxiliary wash tub 100.

The tub 20 may be arranged inside the cabinet 10 to store the wash water. The tub 20 may be supported against the cabinet 10 by a suspension member (not shown). For example, the tub 20 may be supported by being hung on the cabinet 10 by the suspension member that couples the lower side of the outside of the tub 20 to an upper portion of the inside of the cabinet 10. The suspension member may dampen the vibration from the tub 20 during washing or spin-drying.

The main wash tub 30-30 may be implemented in the form of a cylinder with an open top. Furthermore, a first wash space 32 may be provided in the main wash tub 30-30 to accommodate laundry. The pulsator 31 may be arranged at the bottom of the main wash tub 3030.

The pulsator 31 may produce water currents by being rotated clockwise or counterclockwise, and the laundry in the main wash tub 30-30 may be stirred along with the water by the water current produced. That is, the pulsator 31 may stir the laundry accommodated in the first wash space 32 with the wash water.

Many through holes 33 may be formed on the outer surface of the main wash tub 30. The wash water may move between the main wash tub 30 and the tub 20 through the through holes 33.

A balancer 90 may be provided in an upper portion of the main wash tub 30. The balancer 90 may include fastening holes 94. With the fastening holes 94 fastened with fastening members (not shown), the balancer 90 may be coupled to the upper portion of the main wash tub 30. The balancer 90 may guide the main wash tub 30 to be stably rotated by offsetting an unbalanced load created on the main wash tub 30 while the main wash tub 30 is rotated at high speed.

The auxiliary wash tub 100 may be implemented in the form with an open top, and may have a second wash space 101 to accommodate laundry. The auxiliary wash tub 100 may be detachably implemented.

Furthermore, the auxiliary wash tub 100 may be installed separately from the main wash tub 30. For example, the auxiliary wash tub 100 may be installed to be separable by the balancer 90 coupled to the upper portion of the main wash tub 30. Hereinafter, the auxiliary wash tub 100 being installed in the main wash tub 30 may include both the auxiliary wash tub 100 being set in the main wash tub 30 and the auxiliary wash tub 100 being coupled with the main wash tub 30.

When the auxiliary wash tub 100 is installed in the main wash tub 30, it may be rotated along with the main wash tub 30. The driving device 40 may provide rotational force to the main wash tub 30 as well as the auxiliary wash tub 100. In this regard, the laundry in the second wash space 101 and the laundry in the first wash space 32 may be washed separately.

In a case that the auxiliary wash tub 100 is detached and separated, the auxiliary wash tub 100 may be used for various purposes. For example, the auxiliary wash tub 100 detached from the main wash tub 30 may be used as a laundry tub for collecting laundry before and after washing, and besides, may be variously used according to the user's preference.

The water supplier 50 may be provided in an upper portion of the cabinet 10 to supply wash water to at least one of the main wash tub 30 and an auxiliary wash tub 100.

Referring to FIG. 2, the water supplier 50 may include a water valve 51 for controlling water supply, a first water tube 52 coupling the water valve 51 and a detergent supplier 60, a second water tube 53 coupling the water valve 51 and an injection nozzle 55 for injecting wash water to an upper portion of the auxiliary wash tub 100, and a third water tube 54 coupling the detergent supplier 60 and a water hole 21 formed at the tub 20.

One end of the water valve 51 may be connected to an external water source and the other end of the water valve 51 may be connected to the first water tube 52 and the second water tube 53 to supply water received from the external water source to the inside.

Furthermore, one end of the first water tube 52 may be connected to the water valve 51 and the other end of the first water tube 52 may be connected to the detergent supplier 60 to supply wash water to the detergent supplier 60.

Moreover, one end of the second water tube 53 may be connected to the water valve 51 and the other end may be connected to the injection nozzle 55 arranged above the auxiliary wash tub 100. Accordingly, the injection nozzle 55 may supply wash water into the auxiliary wash tub 100 through the second water tube 53.

One end of the third water tube 54 may be connected to the detergent supplier 60 and the other end of the third water tube 54 may be connected to the water hole 21 formed on the outer surface of the tub 20. The third water tube 54 may supply wash water in which a detergent is dissolved, to the space between the tub 20 and the main wash tub 30 via the detergent supplier 60. The wash water supplied into the tub 20 through the third water tube 54 may be stored in the main wash tub 30 through the through holes 33.

The detergent supplier 60 may be arranged under the top cover 15. The detergent supplier 60 may include a case 63 coupled with the first water tube 52, and a detergent container 61 that is detachable from the case 63 and has internal space to contain detergents.

A discharging port 65 may be formed at the bottom of the case 63 to release the wash water in which the detergent is dissolved. The discharging port 65 may be coupled with the third water tube 54. The water supplied through the first water tube 52 may pass through the detergent supplier 60 and the third water tube 54 and may be supplied into the space between the main wash tub 30 and the tub 20 along with the detergent.

A drain hose 70 may be arranged under the tub 20 to drain the wash water out of the cabinet 10 after washing or spin-drying is completed.

The driving device 40 may include a clutch 120 for selectively rotating the main wash tub 30 and the pulsator 31, a driving motor 150 for driving the clutch 120, a flange member 140 connecting a driving shaft 124 of the clutch 120 to the bottom of the main wash tub 30 for transmitting rotational force of the driving shaft 124 to the main wash tub 30, and a base plate 160 fixing the clutch 120 and the driving motor 150. Furthermore, the driving device 40 may include a pulley 135 to fix the clutch 120 and the driving motor 150.

The auxiliary wash tub 100 will now be described in more detail.

Referring to FIG. 3, the balancer 90 may include an opening 91 through which laundry is thrown into the main wash tub 30, a support rib 93 extending upward along the circumference of the opening 91, and the fastening holes 94.

The balancer 90 may be coupled to an upper portion of the main wash tub 30 through the fastening holes 94 and fastening members (not shown). The auxiliary wash tub 100 may be detachably installed at the balancer 90 arranged in the upper portion of the main wash tub 30. For example, the auxiliary wash tub 100 may be set on the top surface 92 of the balancer 90, as shown in FIG. 3. This enables the auxiliary wash tub 100 to be rotated along with the main wash tub 30.

In the meantime, the auxiliary wash tub 100 may include a basket part 102 forming the second wash space 101, and a cover part 110 forming a laundry inlet 117.

The basket part 102 may include a bottom wall 104 and a side wall 103. The side wall 103 may have a drain hole to drain wash water according to centrifugal force resulting from rotation of the auxiliary wash tub 100. For this, the side wall 103 may be formed to incline outward against the bottom wall 104. Accordingly, the basket part 102 may have larger cross-sectional areas toward its top, as shown in FIG. 3.

With the sloping side wall 103, the wash water in the auxiliary wash tub 100 may move toward the top of the side wall 103 as the auxiliary wash tub 100 is rotated. That is, the wash water moves to the side wall 103 according to the centrifugal force and then moves upward along the slope of the side wall 103. A drain hole is formed in an upper portion of the side wall 103, and the wash water that has passed through the drain hole may drain through a drain path.

In an attempt to do separate washing, the user may install the auxiliary wash tub 100 in the main wash tub 30. The washing machine 1 may then perform washing courses in the first wash space 32 and the second wash space 10, separately.

When it is considered inappropriate to wash clothes together in the main wash tub 30 due to the nature of the clothes, such as a possibility of being stained between the clothes, the user may install the auxiliary wash tub 100 to perform washing separately from the laundry contained in the main wash tub 30.

However, even when the clothes are washed in the main wash tub 30 and the auxiliary wash tub 100, separately, if the wash water of the auxiliary wash tub 100 drains into the main wash tub 30 during a spin-drying course, the clothes in the main wash tub 30 might be contaminated or stained.

Therefore, the auxiliary wash tub 100 of the washing machine 1 according to an embodiment may include a drain path for draining the wash water of the auxiliary wash tub 100 to the space between the main wash tub 30 and the tub 20. For example, in a case of performing a spin-drying course on the laundry in the auxiliary wash tub 100, the wash water in the second wash space 101 of the auxiliary wash tub 100 drains to the outside of the main wash tub 30 and thus the clothes in the main wash tub 30 is not stained or contaminated by the wash water from the auxiliary wash tub 100.

The auxiliary wash tub 100 may be set on the top surface 92 of the balancer 90 to come close to an upper portion 33 of the tub 20, as shown in FIG. 4. The upper portion 33 of the tub 20 is referred to as an upper frame 33 of the tub 20, or as a tub cover 33. The tub cover 33 may be implemented to be separable from the tub 20 or to be integrated with the tub 20.

Since the auxiliary wash tub 100 is detachable, it may not be properly installed due to the user's mistake. If a washing course is performed even with the auxiliary wash tub 100 that is not properly installed, the washing machine 1 might be damaged. Furthermore, the wash water in the second wash space 101 might not drain to the outside of the main wash tub 30 but flow into the first wash space 101, causing staining or contamination among the clothes.

Moreover, the auxiliary wash tub 100 has a knob G formed thereon, as shown in FIG. 5, and the user may easily detach the auxiliary wash tub 100 with the knob G. In this regard, if the knob G is inconveniently oriented for the user, the user has to move the knob G by turning the auxiliary wash tub 100 in person, which is inconvenient for the user.

In addition, since the auxiliary wash tub 100 has an open top, clothes in the second wash space 101 might fall out through the top of the auxiliary wash tub 100 while the auxiliary wash tub 100 is rotated. If a washing course is performed even with the clothes falling out, the clothes might be damaged by the rotation of the auxiliary wash tub 100. The washing machine 1 according to an embodiment solves this problem, and increase convenience for the user and prevent damage of the washing machine 1 and the laundry. To explain how the washing machine 1 according to an embodiment solves the problem, a control block diagram of the washing machine 1 will now be described first.

Figure 6:
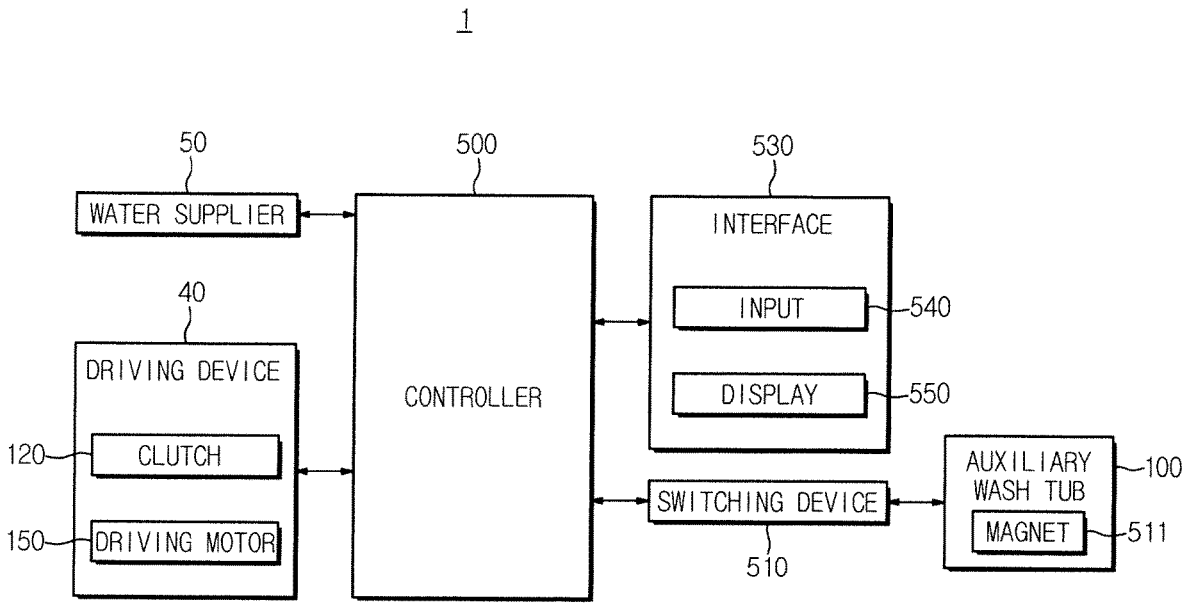
FIGS. 6 and 7 are control block diagrams of a washing machine, according to different embodiments.
Figure 7:
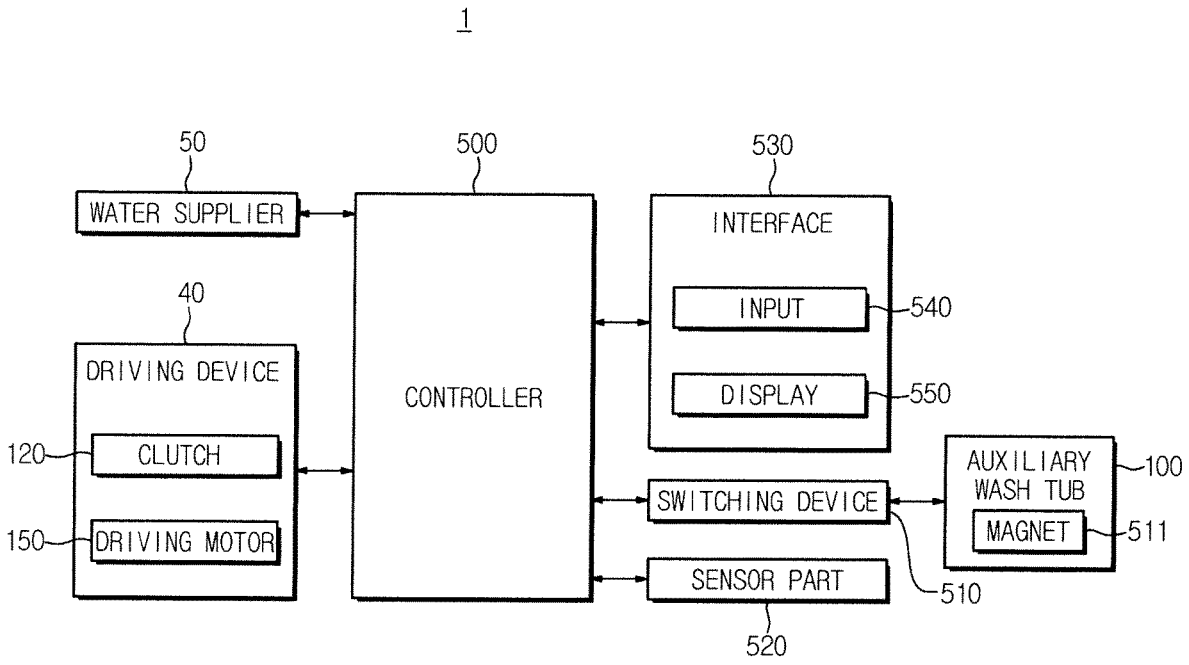
Figure 8:
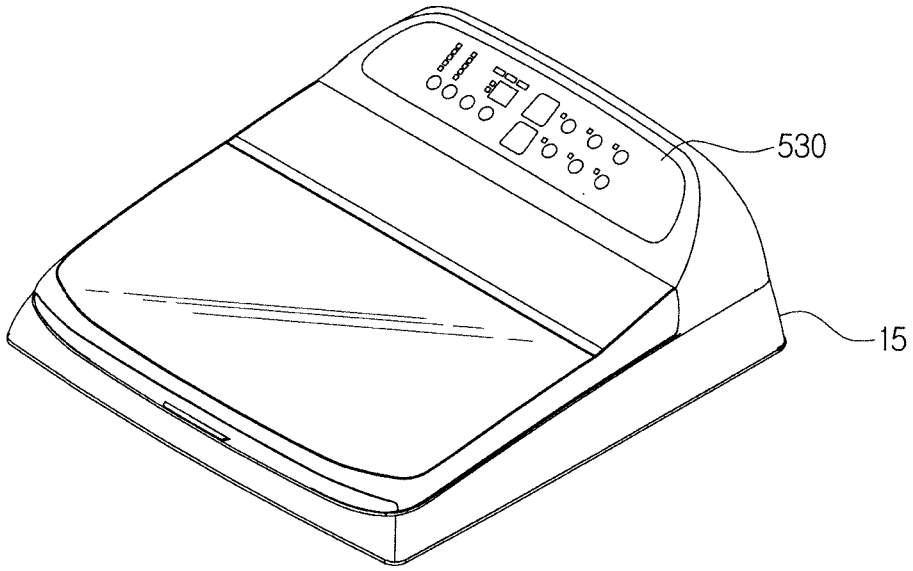
FIG. 8 shows an interface provided on a top cover of a washing machine, according to an embodiment.
Figure 9:
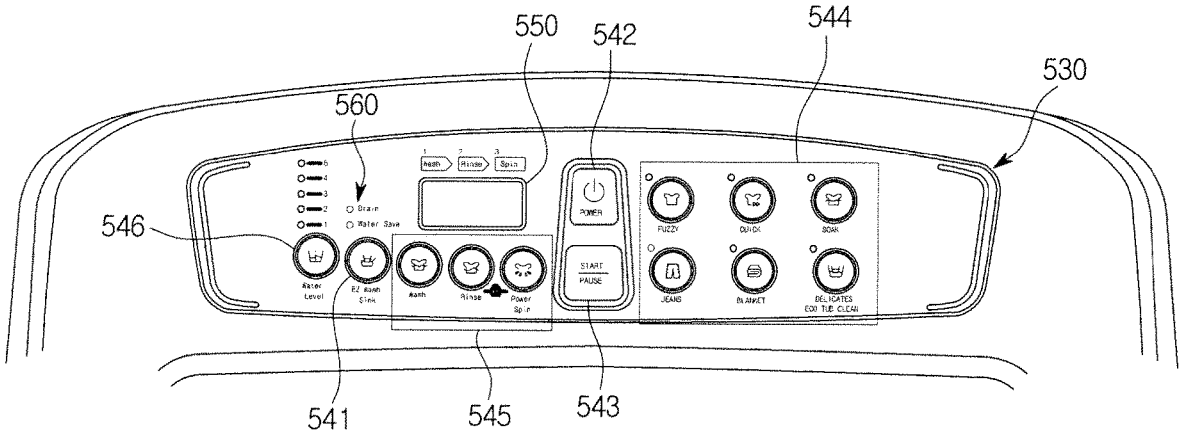
FIG. 9 shows various buttons provided on an interface, according to an embodiment.
Figure 10:
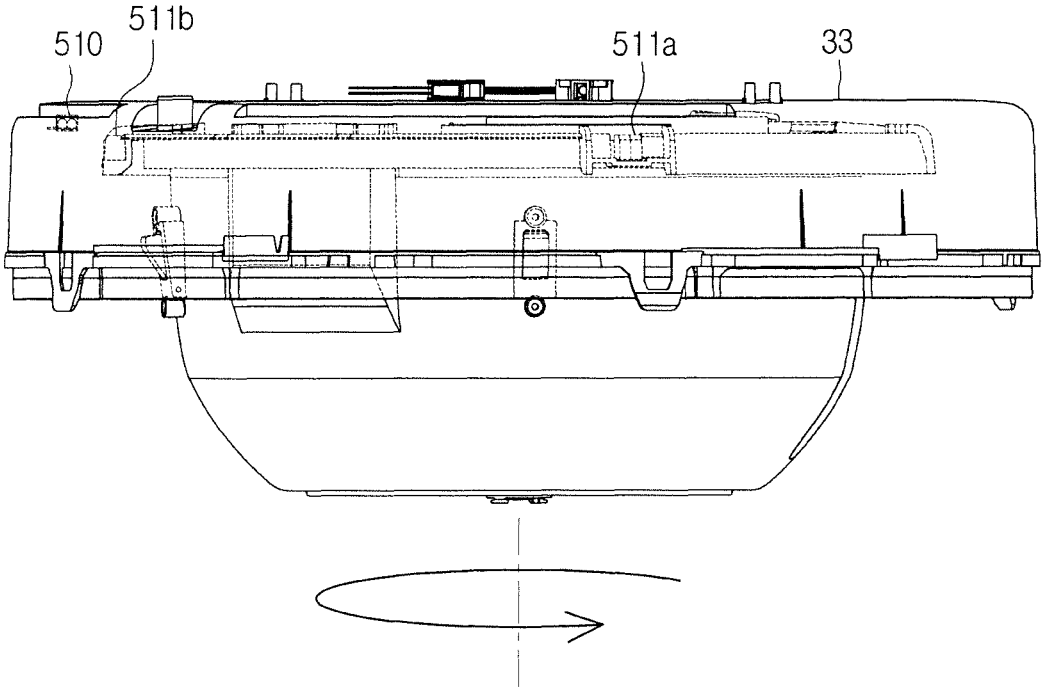
FIG. 10 is a cross-sectional view of an auxiliary wash tub and top frame of a tub in a washing machine, according to an embodiment.
Figure 11:
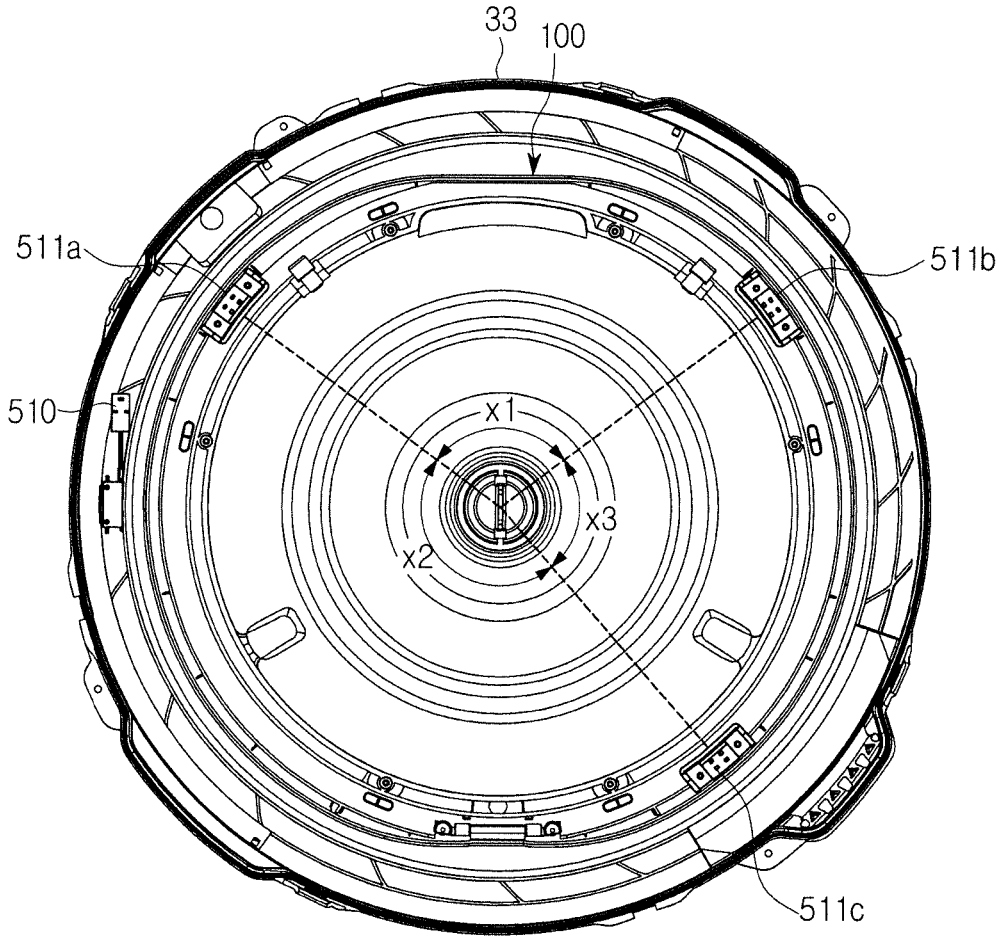
FIG. 11 is a bottom view of an auxiliary wash tub of a washing machine, according to an embodiment.
Figure 12:
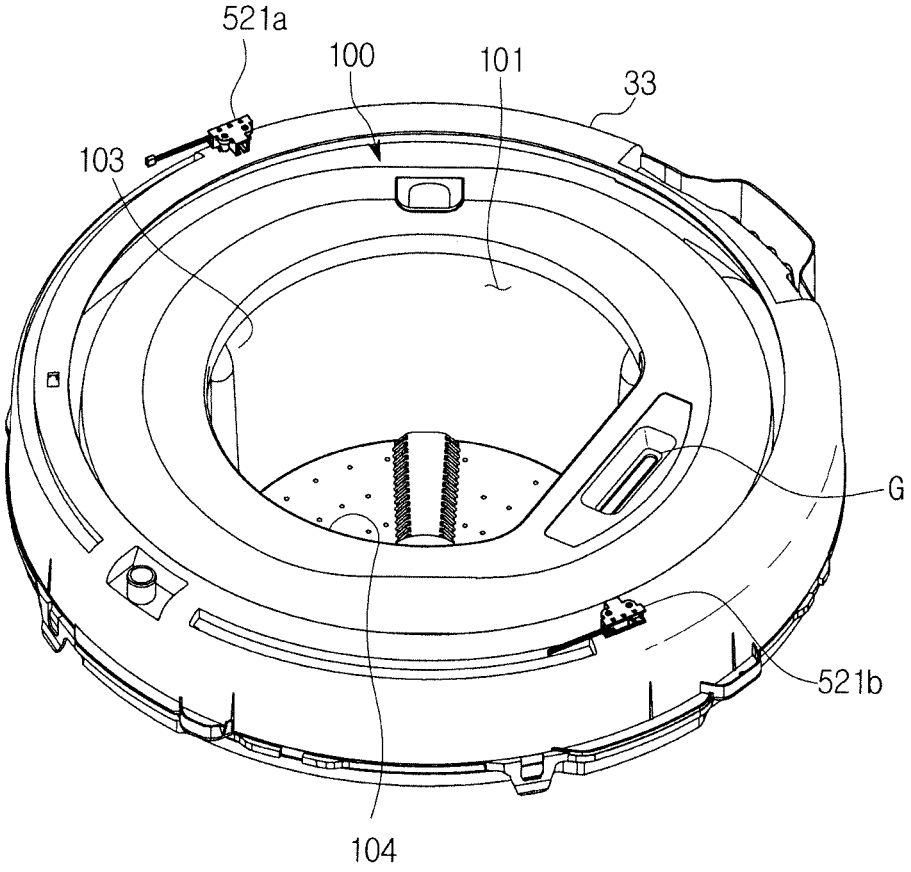
FIG. 12 shows a sensor part attached to an upper portion of a tub, according to an embodiment.
Figure 13:
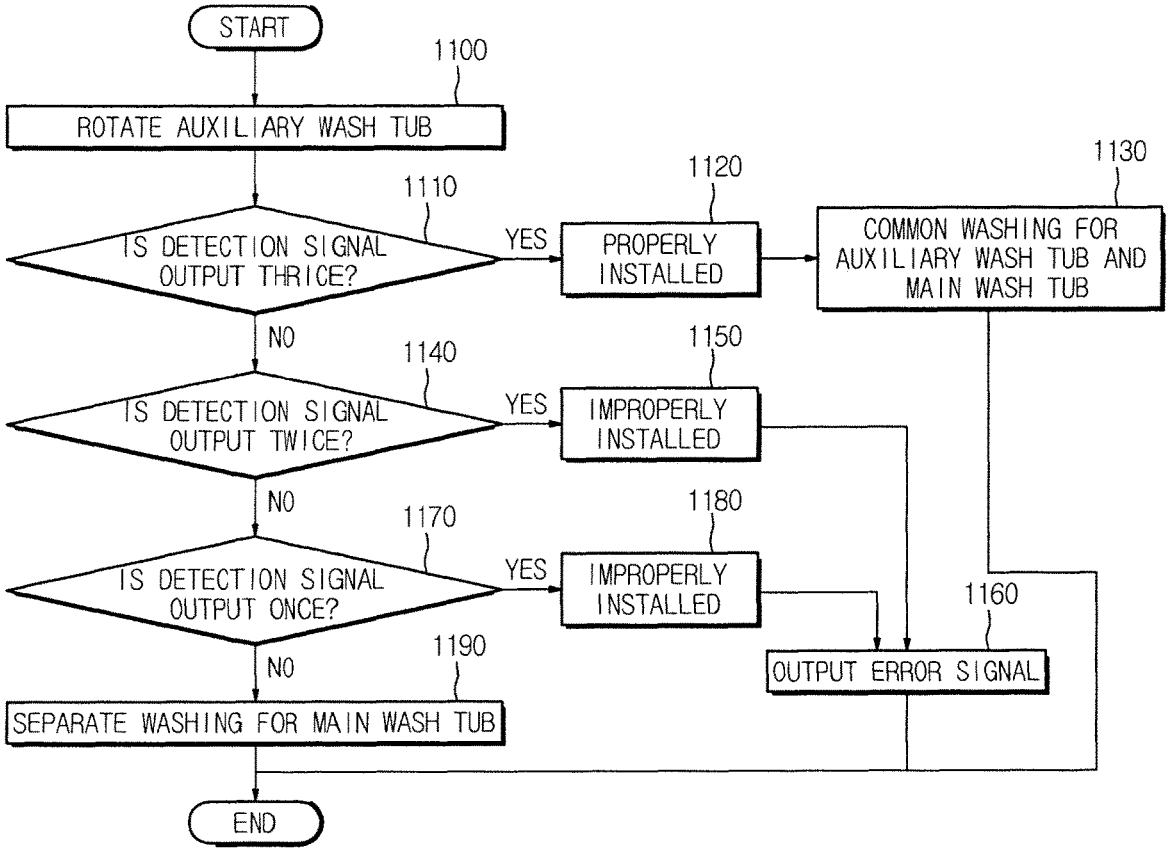
FIG. 13 is a flowchart of an operation of a washing machine to determine at least one of whether an auxiliary wash tub is installed and whether the auxiliary wash tub is properly installed, according to an embodiment.
Figure 14:
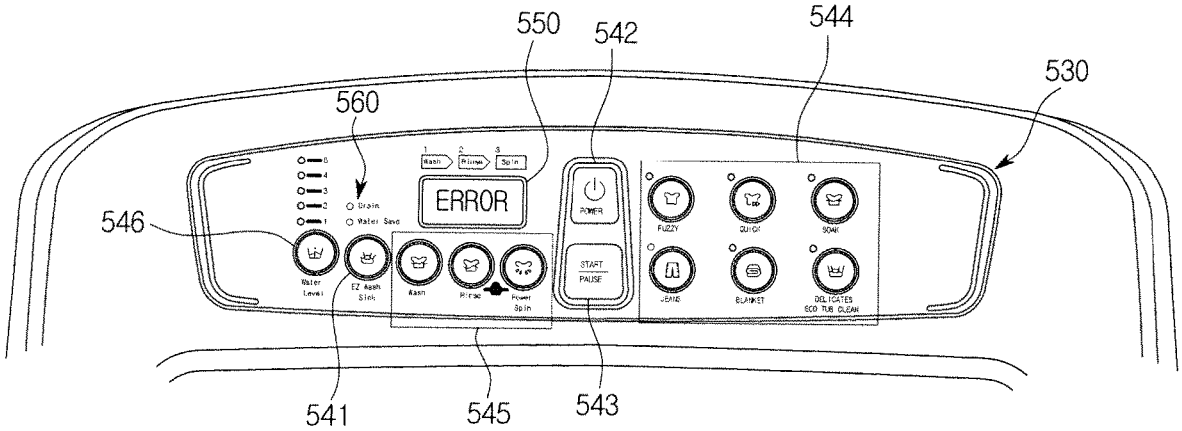
FIG. 14 shows a screen with an error message displayed on a display, according to an embodiment.
Figure 15:
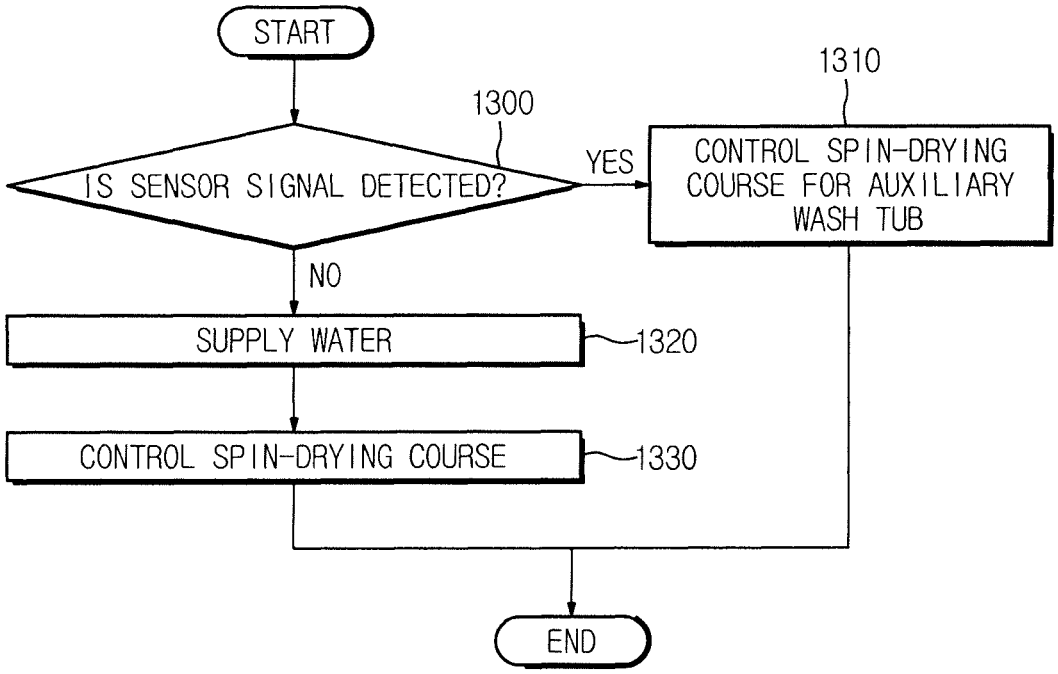
FIG. 15 is a flowchart of an operation of a washing machine to control the position of a knob, according to an embodiment.
Figure 16:
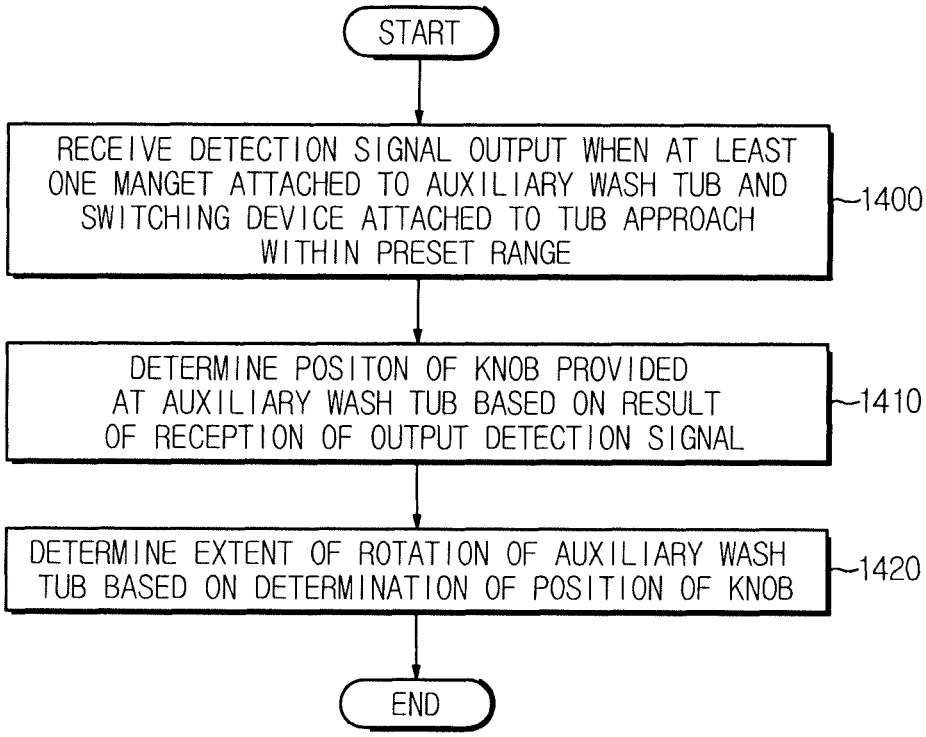
FIG. 16 is a flowchart of an operation of a washing machine to determine whether the laundry deviates based on a sensor signal, according to an embodiment.

FIGS. 6 and 7 are control block diagrams of a washing machine, according to different embodiments, and FIG. 8 shows an interface provided on a top cover of a washing machine, according to an embodiment. FIG. 9 shows various buttons provided on an interface, according to an embodiment, and FIG. 10 is a cross-sectional view of an auxiliary wash tub and top frame of a tub in a washing machine, according to an embodiment. FIG. 11 is a bottom view of an auxiliary wash tub of a washing machine, according to an embodiment, and FIG. 12 shows a sensor part attached to an upper portion of a tub, according to an embodiment. FIG. 13 is a flowchart of an operation of a washing machine to determine at least one of whether an auxiliary wash tub is installed and whether the auxiliary wash tub is properly installed, according to an embodiment, and FIG. 14 shows a screen with an error message displayed on a display, according to an embodiment. FIG. 15 is a flowchart of an operation of a washing machine to control the position of a knob, according to an embodiment, and FIG. 16 is a flowchart of an operation of a washing machine to determine whether the laundry deviates based on a sensor signal, according to an embodiment. The figures will now be described together to avoid repetition of explanation.

Referring to FIG. 6, the washing machine 1 may include the aforementioned water supplier 50 and driving device 40 including the clutch 120 and the driving motor 150, a switching device 510, and a controller 500. Furthermore, the washing machine 1 may further include the auxiliary wash tub 100 having a magnet 511 installed therein. The driving device 40 and the water supplier 50 are described above, so the detailed description thereof will not be repeated. The other respective components will now be described.

The interface 530 may receive various control commands from the user and provide various information. The interface 530 may also be referred to as a control panel, but hereinafter, for convenience of explanation, will be collectively called the interface 530.

The interface 530 may be provided on one side of the washing machine 1. For example, the interface 530 may be provided on the top cover 15 (see FIG. 1) of the washing machine 1, as shown in FIG. 8.

The interface 530 may include an input 540 and a display 550. The input 540 may include at least one button to receive various control commands from the user.

For example, the input 540 may further include, as shown in FIG. 9, a drain input button 541 to receive a drain input, a power button 542 to receive a power on/off input, a start button 543 to receive a start/pause input for a washing course, a washing type selection button 544 to receive an input to select a washing type, a washing course selection button 545 to receive an input to select a washing course, and a water level decision button 546 to receive an input to determine a level of wash water to be supplied.

These buttons may be implemented by various types of buttons already known to the public. For example, the buttons may be implemented with pressure-type buttons, to which the user inputs a control command by pressing the button, or rotary type buttons, to which the user inputs a control command by holding and rotating the button. In addition, the buttons may be implemented with touch screen type buttons, to which the user inputs a control command by touching the button, and there are no limitations on the buttons.

The display 550 may visually present various information such as operation state of the washing machine 1 and a state of user manipulation. Accordingly, the user may check the various information through the display 550. The display 550 may be implemented by a Cathode Ray Tube (CRT) display panel, a Liquid Crystal Display (LCD) panel, a Light Emitting Diode (LED) panel, Organic Light Emitting Diodes (OLEDs), a Plasma Display Panel (PDP), a Field Emission Display (FED) panel, or any other device that may visually present various information regarding the washing machine 1.

The display 550 and the input 540 may be located to be adjacent to each other. The display 550 and the input 540 located to be adjacent to each other are beneficial for the user in that the user may immediately check a result corresponding to an input command that the user enters through the input 500.

As will be described later, the controller 500 may receive various control commands through the input 540, and in response to the input control command, determine whether the auxiliary wash tub 100 is installed as well as whether the auxiliary wash tub 100 is properly installed to perform various washing courses, spin-drying courses, etc., and display various information on the display 550 resulting from the determination.

In addition, the controller 500 may determine whether the laundry deviates from the auxiliary wash tub 100, and according to the determination, display various information on the display 550. This will be described in more detail later.

Referring to FIG. 6, the washing machine 1 may include the auxiliary wash tub 100 with a magnet 511 attached thereto. The auxiliary wash tub 100 is not limited to having a single magnet, but may include a plurality of magnets.

Although it will be assumed that the auxiliary wash tub 100 has three magnets, for convenience of explanation, e.g., a first magnet, a second magnet, and a third magnet, attached onto one side of the auxiliary wash tub 100, it is not limited thereto but any number of magnets may be attached to the auxiliary wash tub 100 in the following embodiments. Furthermore, in the following description, the first, second, and third magnets may be simply called the magnet if there is no need to distinguish them.

The first, second, and third magnets may be attached to one side of the auxiliary wash tub. The first, second, and third magnets 511*a*, 511*b*, and 511*c* attached to one side of the auxiliary wash tub 100 are rotated as well as the auxiliary wash tub 100 is rotated, as shown in FIG. 10.

For example, the first, second, and third magnets may be attached to one side or inner side of the cover part 110 of the auxiliary wash tub 100. In an embodiment, the first, second, and third magnets 511*a*, 511*b*, and 511*c* may be attached onto the bottom of the cover part 110 of the auxiliary wash tub 100, as shown in FIG. 11. There are no limitations on how to attach magnets to the auxiliary wash tub 100, and the magnet may be attached in various ways known to the public.

When the first, second, and third magnets 511*a*, 511*b*, and 511*c* approach the switching device 510, the switching device 510 may output a detection signal, and based on it, the controller 500 may determine whether the auxiliary wash tub is installed as well as whether the auxiliary wash tub is properly installed. Accordingly, there are no limitations on the design methods as long as the switching device 510 is arranged at a location at which to detect the first, second, and third magnets 511*a*, 511*b*, and 511*c* even if the first, second, and third magnets 511*a*, 511*b*, and 511*c* are arranged at any available side, such as a lateral side or the top side of the auxiliary wash tub 100.

The first, second, and third magnets 511*a*, 511*b*, and 511*c* may be attached so that they may work at intervals of 120 degrees. Alternatively, the first, second, and third magnets 511*a*, 511*b*, and 511*c* may be attached at irregular intervals.

For example, referring to FIG. 11, around the center of the auxiliary wash tub 100, a difference in angle between the first and second magnets 511*a* and 511*b*, i.e., phase difference c1, may be different from phase difference x2 between the second and third magnets 511*b* and 511*c*. Phase difference x3 between the first and third magnets 511*a* and 511*c* may be different from x1 and x2.

In this regard, as the auxiliary wash tub 100 is rotated at a set rotation speed for a set period of time, the positions of the magnets 511*a*, 511*b*, and 511*c* and phase differences among the magnets 511*a*, 511*b*, and 511*c* may be determined based on points of time at which the respective magnets 511 are detected. Accordingly, there are no limitations on how to arrange the magnets 511 on the auxiliary wash tub according to embodiments.

Furthermore, as will be described later, since positional information between the magnet 511 and the knob G is stored in a memory of the washing machine 1 in advance, the controller 500 may be able to perform position control on the auxiliary wash tub 100 based on the data stored in the memory, so there are no limitations on where to arrange the magnets 511.

In the meantime, the washing machine 1 may be equipped with the switching device 510.

The switching device 510 may output a detection signal when the magnet approaches within a preset range. For example, the switching device 510 may be implemented with a read switch, and may also be implemented with various elements known to the public, which may detect the magnet 511 and output a detection signal.

The switching device 510 may be provided at a position adjacent to the auxiliary wash tub 100. The switching device 510 may be arranged at a position at which to detect the magnet 511 rotated along the auxiliary wash tub 100 when the auxiliary wash tub 100 is rotated.

For example, the switching device 510 may be attached at a location adjacent to the auxiliary wash tub 100, such as at an upper portion of the tub 20 or at an upper portion of the balancer 90. In an embodiment, the switching device 510 may be attached to the inner side of the tub cover 33, as shown in FIG. 10, to detect the magnet 511 rotated as the auxiliary wash tub 100 is rotated.

When the magnet 511 attached to the auxiliary wash tub 100 approaches within a preset range to the switching device 510, magnetic force may be produced between the switching device 510 and the magnet 511. The switching device 510 may output a detection signal based on the magnetic force. The preset range is a range within which a detection signal is output due to the magnetic force produced between the switching device 510 and the magnet 511, which may be determined according to specifications of the switching device 510 and magnet 511.

The switching device 510 and the controller 500 may be coupled wiredly or wirelessly, and the controller 500 may determine whether a detection signal is output from the switching device 510 or may receive the output detection signal. The controller 500 will be described later in more detail.

The washing machine 1 may further include the sensor part 520, as shown in FIG. 7.

The sensor part 520 may be implemented with various sensors known to the public, which may be able to detect an object, such as laundry. For example, the sensor part 520 may be implemented with a first infrared ray (IR) sensor 521*a* and a second IR sensor 521*b*, which are located opposite each other, as shown in FIG. 12.

The first and second IR sensors 521*a* and 521*b* may be attached to an upper portion of the tub 20, e.g., the top surface of the tub cover 33, or to any place to detect whether there is laundry at the open top of the auxiliary wash tub 100. Arrangement of the first and second IR sensors 521*a* and 521*b* may be done in various ways known to the public, without limitation.

In another example, the sensor part 520 may be implemented with an ultrasonic sensor to irradiate an ultrasound signal, receive an ultrasound signal reflected from laundry, and detect whether the laundry deviates, a three dimensional (3D) sensor to determine the laundry from an image, etc., without being limited thereto. In the following description, it will be assumed, for convenience of explanation, that the sensor part 520 is implemented with IR sensors, but the following embodiments are not limited thereto and there may be other various sensors known to the public.

The sensor part 520 may be attached to an upper portion of the auxiliary wash tub 100 to detect whether laundry falls out of the opening at the top of the auxiliary wash tub 100. When there is no laundry between the first and second IR sensors 521*a* and 521*b*, the IR sensors 521*a* and 521*b* may exchange sensor signals with each other. Otherwise, when there is an object between the first and second IR sensors 521*a* and 521*b*, the IR sensors 521*a* and 521*b* may exchange no sensor signal due to the object.

Since the sensor part 520 and the controller 500 are connected wiredly or wirelessly, the controller 500 may determine a transmission or reception result, i.e., a detection result of a sensor signal of the sensor part 520. The controller 500 may determine a transmission or reception result of a sensor signal from the sensor part 520 and based on the result, determine whether the laundry deviates. The controller 500 will be described later in more detail.

The sensor part 520 may have a built-in battery to supply its own power and thus exchange sensor signals. Alternatively, the sensor part 520 may receive power from the controller 500 connected thereto wiredly or wirelessly, or receive power directly from a power source of the washing machine 1, without being limited thereto.

The controller 500 provided in the washing machine 1 may control general operation of the components of the washing machine 1.

The controller 500 may be implemented with various computing devices, such as a processor or a micro control unit (MCU), which is able to perform a computational process, and memories. The memory may store an algorithm for a method of controlling operation of the washing machine 1 and programmed data, and the controller 500 may use the data stored in the memory to control the components of the washing machine 1.

For example, the controller 500 may generate control signals to control operation of the components of the washing machine 1. In an embodiment, upon receiving a control command from the user through the interface 530 provided at the washing machine 1, the controller 500 controls the components of the washing machine 1 with control signals to perform an operation corresponding to the control command input by the user.

A method for the controller 500 to determine at least one of whether the auxiliary wash tub 100 is installed and whether the auxiliary wash tub 100 is properly installed will now be described.

Referring to FIG. 13, the controller 500 may control rotation of the auxiliary wash tub 100 with a control signal, in 1100. For example, the controller 500 may rotate the auxiliary wash tub 100 at preset rotation speed for a preset period of time based on the data stored in the memory. In the meantime, since it is not currently clear whether the auxiliary wash tub 100 is installed, rotating the auxiliary wash tub 100 means rotating the components in the washing machine 1 that apply rotational force transmitted from the driving device to the auxiliary wash tub 100.

The preset period of time for rotation may be time taken to rotate the auxiliary wash tub 100 by 360 degrees, i.e., one turn, and may be set in advance according to the diameter and rotation speed of the auxiliary wash tub 100.

For example, the controller 500 may rotate the auxiliary wash tub 100 clockwise or counterclockwise at 20 rpm for 3 seconds. When the first, second, and third magnets 511*a*, 511*b*, and 511*c* approach within a preset range to the switching device 510 as the auxiliary wash tub 100 is rotated, the switching device 510 may output a detection signal. At this time, the controller 500 may determine not only whether the auxiliary wash tub 100 is installed but also whether the auxiliary wash tub 100 is properly installed, based on the number of times of the detection signal being output or received from the switching device 510.

For example, when the detection signal is output thrice in 1110, i.e., when the detection signal is output thrice when the first to third magnets 511*a*, 511*b*, and 511*c* approaches the switching device 510, the controller 500 may determine that the auxiliary wash tub 100 is installed as well as that the auxiliary wash tub 100 is properly installed, in 1120. At this time, upon receiving a control command for a washing course from the user, the controller 500 may control the components in the washing machine 1 to perform a common washing course for the auxiliary wash tub 100 and the main wash tub 20, in 1130.

When the detection signal is output twice in 1140, i.e., when two of the first to third magnets 511*a*, 511*b*, and 511*c* come close to the switching device 510 and thus the detection signal is output twice, the controller 500 may determine that the auxiliary wash tub 100 is installed but improperly installed, in 1150.

The controller 500 may request the user to retry installing the auxiliary wash tub 100 by outputting an error signal without performing the common washing, in 1160. Accordingly, the washing machine 1 in accordance with the embodiment may prevent the washing machine 1 and the laundry from being damaged.

For example, the controller 500 may display an error message on the display 550, as shown in FIG. 14. Furthermore, the controller 500 may output a beep sound through a speaker of the washing machine 1, and there are no limitations on how to output an error signal.

When the detection signal is output once in 1170, i.e., when one of the first to third magnets 511*a*, 511*b*, and 511*c* comes close to the switching device 510 and thus the detection signal is output once, the controller 500 may determine that the auxiliary wash tub 100 is installed but improperly installed, in 1180. The controller 500 may then output an error signal as described above, in 1160.

When no detection signal is output, i.e., when any of the first to third magnets 511*a*, 511*b*, and 511*c* does not approach the switching device 510 and thus no detection signal is output, the controller 500 may determine that the auxiliary wash tub 100 is not installed and perform a separate washing course for the main wash tub, in 1190. The washing machine 1 according to an embodiment may give the user convenience by automatically determining whether the auxiliary wash tub 100 is installed without receiving extra confirmation from the user on whether the auxiliary wash tub 100 is installed.

When the washing machine 1 is powered on, the controller 500 may determine at least one of whether the auxiliary wash tub 100 is installed and whether the auxiliary wash tub 100 is properly installed, at preset intervals. However, it is not efficient for the controller 500 to determine whether the auxiliary wash tub 100 is installed and whether the auxiliary wash tub 100 is properly installed while the washing machine 1 is powered on.

In an embodiment, the controller 500 may determine at least one of whether the auxiliary wash tub 100 is installed and whether the auxiliary wash tub 100 is properly installed in a particular interval or at a particular point of time, thereby increasing energy efficiency. The particular interval or particular point of time is an interval or point of time in which or at which determination of at least one of whether the auxiliary wash tub 100 is installed and whether the auxiliary wash tub 100 is properly installed is required, and information about the particular interval or particular point of time may be stored in the memory of the controller 500 and changed according to preferences of the user.

For example, in an embodiment, the controller 500 may determine at least one of whether the auxiliary wash tub 100 is installed and whether the auxiliary wash tub 100 is properly installed in an interval from when the power is on until when a command to start any of various courses such as a washing course, a spin-drying course, etc., is received.

In an embodiment, the controller 500 may determine whether the auxiliary wash tub 100 is installed and whether the auxiliary wash tub 100 is properly installed in an interval in which the user presses the power button 542 of FIG. 9 but no control command is input through the start button 543 of FIG. 9, the washing type selection button 544 of FIG. 9, the washing course selection button 545 of FIG. 9, and a water level decision button 546 of FIG. 9. Therefore, once receiving a command to start a washing course, a rinsing course, etc., the controller 500 may reflect the aforementioned determination result in controlling the components of the washing machine 1 based on the received control command.

In another embodiment, when the user presses the start button 543 of FIG. 9, the controller 500 may determine at least one of whether the auxiliary wash tub 100 is installed and whether the auxiliary wash tub 100 is properly installed, at the point of time at which the start button 543 of FIG. 9 is pressed.

In yet another embodiment, the controller 500 may determine at least one of whether the auxiliary wash tub 100 is installed and whether the auxiliary wash tub 100 is properly installed before performing a draining course. In still another embodiment, when a start command is received after the user inputs a pause command through the start button 543, the controller 500 may determine at least one of whether the auxiliary wash tub 100 is installed and whether the auxiliary wash tub 100 is properly installed. In addition, in some embodiments, the controller 500 may perform the aforementioned operation at a time required to determine at least one of whether the auxiliary wash tub 100 is installed and whether the auxiliary wash tub 100 is properly installed, without being limited thereto.

In the meantime, the knob G (see FIG. 5) may be formed on the top edge of the auxiliary wash tub 100, as described above. The user may use the knob G of FIG. 5 to easily remove the auxiliary wash tub 100 and use it as a laundry tub more easily. However, when the user attempts to remove the auxiliary wash tub 100 and the knob is positioned in the direction of the side-rear cover 13, it is inconvenient to use the knob 5 of FIG. 5.

Accordingly, in an embodiment, the controller 500 may control rotation of the auxiliary wash tub 100 so that the auxiliary wash tub 100 is positioned at a place for the user to easily use the knob G, i.e., at a right place. The term 'right place' refers to a position at which the user who stands in front of the washing machine 1 may easily grip the knob G of FIG. 5, i.e., an occasion when the knob G of FIG. 5 is positioned toward the front cover 11 (see FIG. 1).

In this case, the user may remove the auxiliary basket 100 more conveniently with the knob G of FIG. 5. How to control the position of the auxiliary wash tub 100 will now be described.

The controller 500 may rotate the auxiliary wash tub 100 with a control signal. For example, the controller 500 may rotate the auxiliary wash tub 100 by 360 degrees, i.e., a single turn, and receive a detection signal output when at least one magnet attached to the auxiliary wash tub 100 approaches within a preset range to the switching device 510 attached to the upper portion 33 of the tub, in 1400.

Information about positions of the first to third magnets 511*a*, 511*b*, and 511*c* may be stored in the memory of the washing machine 1, as described above. Furthermore, information about a position of the knob may be stored in the memory of the washing machine 1.

The information about a position of the knob may be set based on the positions of the first to third magnets 511*a*, 511*b*, and 511*c*. For example, the memory may store information about to what extent and in what direction rotation is performed for the knob to be positioned in the right place from at least one of the first to third magnets 511*a*, 511*b*, and 511*c*.

The controller 500 may determine a position of the knob based on a result of determination of a position of at least one of the first to third magnets, in 1410, and determine an extent of rotation of the auxiliary wash tub 100 based on the determination of the position, in 1420. The controller 500 may then rotate the auxiliary wash tub 100 with a control signal for the knob to be in the right place.

In an embodiment, the controller 500 may control the position of the auxiliary wash tub 100 only at a particular point of time or in a particular interval. The particular point of time or particular interval refers to a point of time or interval expected for the user to remove the auxiliary wash tub 100. The information about the particular interval or particular point of time may be stored in the memory of the controller 500, or changed according to preferences of the user.

For example, the controller 500 may control rotation of the auxiliary wash tub 100 such that the knob of the auxiliary wash tub 100 is positioned in the right place at a time when an operation corresponding to a control command received from the user is completed.

Furthermore, the controller 500 may control the auxiliary wash tub 100 to move to the right place even after detecting based on the aforementioned operation that the auxiliary wash tub 100 is installed. Hence, when the auxiliary basket 100 needs to be removed or re-installed because the user changes his/her mind or the auxiliary basket 100 is installed but improperly installed, the controller 500 may control the auxiliary basket 100 to move to the right place. Accordingly, the washing machine 1 in accordance with the embodiment may allow the user to remove or re-install the auxiliary basket 100 more conveniently.

Furthermore, when the user inputs a pause command, the user may be more likely to open the door to add the laundry or remove the auxiliary basket 100. In this case, the controller 500 may control the position of the auxiliary basket 100 even when receiving the pause command.

In addition, the controller 500 may determine whether the laundry deviates from the auxiliary basket 100, as described above. A method of determining whether the laundry deviates from the auxiliary wash tub 100 will now be described.

Depending on whether there is an object, e.g., laundry, between the first and second IR sensors 521*a* and 521*b*, the transmission or reception result of the sensor signal may vary. There being laundry between the first and second sensors 521*a* and 521*b* means that the laundry deviates from the auxiliary wash tub 100.

Accordingly, referring to FIG. 15, the controller 500 may determine whether the laundry deviates based on a detection result of a sensor signal of the sensor part 520, i.e., the result of the transmission or reception, i.e., detection, of the sensor signal between the first and second IR sensors 521*a* and 521*b*, in 1300.

Operation of the controller 500 may vary depending on the result of determination of whether the laundry deviates For example, when it is time to perform a spin-drying course after completion of a washing course, the controller 500 may perform a different operation based on a result of determination of whether the laundry deviates.

In an embodiment, when a sensor signal is detected, i.e., when sensor signals are properly exchanged between the first and second IR sensors 521*a* and 521*b* because there is no laundry between them, the controller 500 may perform a spin-drying course on the laundry in the auxiliary wash tub 100 by controlling the components in the washing machine 1, in 1310.

On the contrary, when no sensor signal is detected, i.e., when no sensor signal is exchanged between the first and second IR sensors 521*a* and 521*b* due to the existence of laundry between them, the controller 500 may control wash water to be supplied for the laundry to be moved down to the inside of the auxiliary wash tub 100, in 1320. When the laundry is moved down to the inside of the auxiliary wash tub 100 and thus a sensor signal is detected, the controller 500 may perform a rinsing course and then perform a spin-drying course, thereby preventing the laundry from being damaged.

Operation flows of a washing machine for determining at least one of whether the auxiliary wash tub 100 is installed and whether the auxiliary wash tub 100 is properly installed based on the detection result of a detection signal will now be described briefly.

Figure 17:
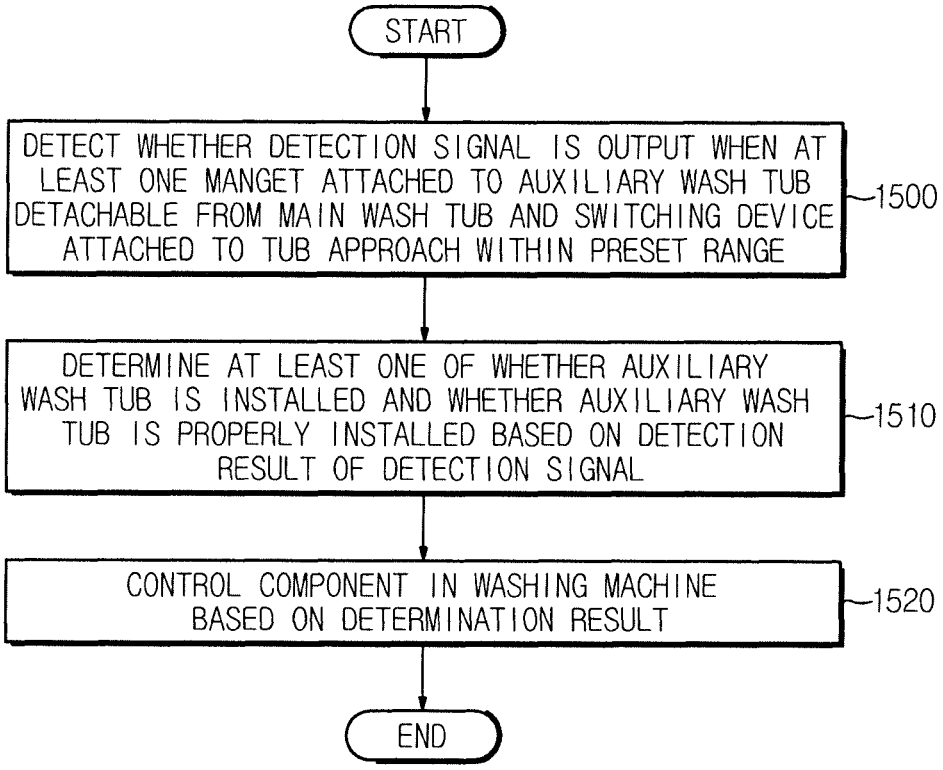
FIG. 17 is a flowchart of an operation of a washing machine to determine at least one of whether an auxiliary wash tub is installed and whether the auxiliary wash tub is properly installed based on a detection result of a detection signal, according to an embodiment.

FIG. 17 is a flowchart of an operation of a washing machine to determine at least one of whether an auxiliary wash tub is installed and whether the auxiliary wash tub is properly installed based on a detection result of a detection signal, according to an embodiment.

An auxiliary wash tub may be installed at an upper portion of a main wash tub of a washing machine, so the washing machine may support separate washing using the auxiliary wash tub in addition to the main wash tub.

For this, the washing machine may detect whether a detection signal is output when at least one magnet approaches within a preset range to a switching device, in 1500, the magnet and the switching device being attached to the auxiliary wash tub.

The switching device may output the detection signal when coming close to the magnet, and may be attached at a place adjacent to the auxiliary wash tub, such as in an upper portion of the tub or an upper portion of the balancer.

The switching device may be connected to the controller wiredly or wirelessly, as described above, so that the controller may detect whether a detection signal is output as well as detect the number of times of the detection signal being output.

The washing machine may determine at least one of whether an auxiliary wash tub is installed and whether the auxiliary wash tub is properly installed based on a reception result of the detection signal, in 1510. For example, the washing machine may provide rotational force to a driving device for rotating the auxiliary wash tub. In this case, when the auxiliary wash tub is installed, a detection signal may be output when at least one magnet and the switching device rotated along with the auxiliary wash tub as the auxiliary wash tub is rotated come close to each other. The washing machine may then detect whether the detection signal is output and determine at least one of whether an auxiliary wash tub is installed and whether the auxiliary wash tub is properly installed.

For example, when no detection signal is detected from the switch even though the rotational force is provided at a preset rotation speed for a preset period of time, the washing machine may determine that the auxiliary wash tub is not installed. Furthermore, when the detection signal is detected at least once from the switching device, the washing machine may determine that the auxiliary wash tub is installed.

The memory of the washing machine may store not only information about a position of the magnet attached to the auxiliary wash tub but also information about the number of magnets. When it is determined that the number of magnets attached to the auxiliary wash tub corresponds to the number of times of the detection signal being detected based on the data stored in the memory, the washing machine may determine that the auxiliary wash tub is properly installed.

Furthermore, when the detection signal is detected at least once but the number of times of the detection signal being detected is less than the number of magnets attached to the auxiliary wash tub, the washing machine may determine that the auxiliary wash tub is improperly installed.

The washing machine may control the components in the washing machine based on the determination result, in 1520. For example, when a control command for e.g., a washing course or a spin-drying course is input from the user, the washing machine may perform a separate washing course or separate spin-drying course for the main wash tub or perform a common washing course or common spin-drying course for the main wash tub and the auxiliary wash tub based on the determination result.

In addition, the washing machine may determine a position of a magnet as well as a position of the auxiliary wash tub based on the number of times of a detection signal being output and points of time at which the detection signal is output. The memory of the washing machine may store information about a relative position between the knob and the magnet on the auxiliary wash tub. Based on the position of the magnet, the washing machine may determine a position of the knob.

The washing machine may determine an extent of rotation of the auxiliary wash tub such that the auxiliary wash tub is positioned in the right place, i.e., such that the knob of the auxiliary wash tub is moved toward the front cover. Accordingly, at a time when the user is expected to open the door to remove the auxiliary wash tub, e.g., at a time when a pause command is input or a washing course is completed, the washing machine may rotate the auxiliary wash tub to determine a position of the magnet and then determine a position of the knob based on the position of the magnet.

The washing machine may determine an extent of rotation of the auxiliary wash tub based on the position of the knob and then rotate the auxiliary wash tub to be positioned at the right place, thereby allowing the user to use the auxiliary wash tub more conveniently.

Configurations described in the embodiments and shown in the accompanying drawings of this specification are only examples, and there may be other various modifications that may replace the embodiments and drawings at the time of filing this application.

Terms as herein used are used to explain embodiments, and should not be construed to restrict and/or limit the scope of the present disclosure. The singular expressions may include plural expressions unless the context clearly dictates otherwise. The term "include" or "have" is inclusive or open-ended and does not exclude additional, unrecited features, numbers, steps, operations, elements, parts, or any combination thereof, unless otherwise mentioned.

Although the terms first, second, third, etc., may be used herein to describe various elements, these elements should not be limited by these terms. These terms are only used to distinguish one element from another. For example, within the scope of the present disclosure, a first element may be designated as a second element, and vice versa. The term "and/or" includes any one or a combination of a plurality of related items mentioned.

The terms as herein used, such as "~unit", "~device", "~block", "~member", "~module", etc., may refer to a unit of processing at least one function or operation. For example, they may refer to software or hardware such as a field-programmable gate array (FPGA) or application-specific integrated circuit (ASIC). However, the terms "~unit", "~device", "~block", "~member", "~module", etc., do not exclusively refer to the software or the hardware, but may refer to what is stored in an accessible storage medium and performed by one or more processors.

The invention claimed is:

1. A washing machine comprising:

at least one magnet attached to an auxiliary wash tub detachable from a main wash tub;

a switching device configured to output a detection signal when the at least one magnet approaches within a preset range to the switching device; and a controller configured to determine whether the auxiliary wash tub is installed based on whether the detection signal of the switching device is output, and control a component in the washing machine based on the determination of whether the auxiliary wash tub is installed, wherein the controller is configured to control the components in the washing machine to perform a common washing course for the auxiliary wash tub and a main wash tub when the controller determines that the auxiliary wash tub is normally installed and receives a control command for a washing course from the user.

2. The washing machine of claim 1, wherein the controller is configured to determine at least one of whether the auxiliary wash tub is installed and whether the auxiliary wash tub is properly installed based on the number of times of the detection signal being output from the switching device as rotational force is provided through a driving device.

3. The washing machine of claim 1, wherein the controller is configured to determine that the auxiliary wash tub is installed based on the number of times of the detection signal from the switching device, and determine whether the auxiliary wash tub is properly installed based on the number of times of the detection signal being output from the switching device as the auxiliary wash tub is rotated at preset rotation speed for a preset period of rotation time.

4. The washing machine of claim 1, wherein the controller is configured to determine a position of the at least one magnet based on the detection signal output from the switching device, and control a position of a knob provided at the auxiliary wash tub based on the determined position of the at least one magnet.

5. The washing machine of claim 1, further comprising: a sensor part attached to an upper portion of a tub provided in the washing machine and configured to detect whether fall out through a top of an auxiliary wash tub while the auxiliary wash tub is rotated.

6. The washing machine of claim 5, wherein the sensor part comprises two infrared ray (IR) sensors located opposite each other in an upper portion of the tub.

7. The washing machine of claim 5, wherein the controller is configured to determine whether laundry accommodated in the auxiliary wash tub deviates based on a detection result through the sensor part, and when it is determined that the laundry deviates, control a component in the washing machine to supply water to the auxiliary wash tub.

8. A control method of a washing machine, the control method comprising:

detecting whether a detection signal is output as at least one magnet attached to an auxiliary wash tub detachable from a main wash tub and a switching device attached to an upper portion of a tub approach within a preset range;

determine at least one of whether the auxiliary wash tub is installed and whether the auxiliary wash tub is properly installed based on the detection of the detection signal; and controlling components in the washing machine to perform a common washing course for the auxiliary wash tub and a main wash tub when the controller determines that the auxiliary wash tub is normally installed and receives a control command for a washing course from the user.

9. The control method of claim 8, wherein the determining comprises:

determining at least one of whether the auxiliary wash tub is installed and whether the auxiliary wash tub is properly installed, based on whether the detection signal is output from the switching device and the number of times of the detection signal being output as rotational force is provided through a driving device.

10. The control method of claim 8, wherein the determining comprises:

determining that the auxiliary wash tub is installed based on the number of times of the detection signal, and determining whether the auxiliary wash tub is properly installed based on the number of times of the detection signal being output as the auxiliary wash tub is rotated at preset rotation speed for a preset period of rotation time.

* * * * *